US009728179B2

(12) United States Patent
Kumar et al.

(10) Patent No.: US 9,728,179 B2
(45) Date of Patent: Aug. 8, 2017

(54) CALIBRATION AND STABILIZATION OF AN ACTIVE NOISE CANCELATION SYSTEM

(71) Applicant: AVNERA CORPORATION, Beaverton, OR (US)

(72) Inventors: Amit Kumar, Portland, OR (US); Thomas Irrgang, Portland, OR (US); Shankar Rathoud, Beaverton, OR (US); Eric Sorensen, Portland, OR (US)

(73) Assignee: AVNERA CORPORATION, Beaverton, OR (US)

( * ) Notice: Subject to any disclaimer, the term of this patent is extended or adjusted under 35 U.S.C. 154(b) by 2 days.

(21) Appl. No.: 14/885,876

(22) Filed: Oct. 16, 2015

(65) Prior Publication Data

US 2017/0110106 A1 Apr. 20, 2017

(51) Int. Cl.
*G10K 11/178* (2006.01)

(52) U.S. Cl.
CPC ..... *G10K 11/1788* (2013.01); *G10K 11/1784* (2013.01); *G10K 2210/1081* (2013.01);
(Continued)

(58) Field of Classification Search
CPC .... H04R 1/1083; H04R 2460/01; H03G 3/24; H03G 3/32; G10K 11/175–11/1788; G10K 2210/1053; G10K 2210/108; G10K 2210/1081; G10K 2210/3014; G10K 2210/3025; G10K 2210/3026; G10K 2210/3027; G10K 2210/3028;
(Continued)

(56) References Cited

U.S. PATENT DOCUMENTS

2002/0082794 A1 6/2002 Kachler et al.
2003/0198354 A1 10/2003 Stuart
(Continued)

FOREIGN PATENT DOCUMENTS

EP 2425424 A1 3/2012
GB 2455826 A 6/2009
WO 2016100602 A1 6/2016

OTHER PUBLICATIONS

"Artificial Ears; P.57 (12/11)", ITU-T Standard, International Telecommunication Union, Geneva, Dec. 14, 2011, pp. 1-50.
(Continued)

*Primary Examiner* — Mark Fischer
(74) *Attorney, Agent, or Firm* — Marger Johnson

(57) ABSTRACT

A method of calibrating an earphone may include: securing an ANC earphone to a calibration fixture, the calibration fixture including an ear model configured to support the ANC earphone, the ear model having an ear canal configured to anatomically resemble a human ear canal and a concha configured to anatomically resemble a human ear concha, the ear canal extending from the concha to an inner end of the ear canal; generating, with the ANC earphone, an audio signal based on a reference tone; determining a characteristic of the audio signal; comparing the characteristic of the audio signal to a previously determined reference characteristic; and adjusting a gain value of the ANC earphone based on the comparing. Additional methods and apparatus are also disclosed.

5 Claims, 6 Drawing Sheets

(52) U.S. Cl.
CPC ..... *G10K 2210/3025* (2013.01); *G10K 2210/3026* (2013.01); *G10K 2210/3027* (2013.01); *G10K 2210/3214* (2013.01); *G10K 2210/504* (2013.01)

(58) Field of Classification Search
CPC ... G10K 2210/3042; G10K 2210/3045; G10K 2210/3056; G10K 2210/3213; G10K 2210/3214; G10K 2210/504
See application file for complete search history.

(56) References Cited

U.S. PATENT DOCUMENTS

| | | | | |
|---|---|---|---|---|
| 2004/0196997 | A1 | 10/2004 | Boonen | |
| 2008/0162072 | A1 | 7/2008 | Copley et al. | |
| 2010/0002891 | A1 | 1/2010 | Shiraishi et al. | |
| 2010/0014685 | A1 | 1/2010 | Wurm | |
| 2012/0140943 | A1 | 6/2012 | Hendrix et al. | |
| 2013/0259251 | A1 | 10/2013 | Bakalos | |
| 2014/0044275 | A1* | 2/2014 | Goldstein | H04R 3/002 381/71.6 |
| 2015/0063614 | A1* | 3/2015 | Petersen | H04R 25/30 381/318 |
| 2016/0300562 | A1* | 10/2016 | Goldstein | G10K 11/1784 |

OTHER PUBLICATIONS

Sushant: "Audiology and Speech-Language Pathology: COUPLERS", URL: http://sushmail.blogspot.de/2011/06/couplers.html, retrieved from the internet on Jan. 1, 2017.

Partial International Search Report for Application No. PCT/US2016/057225 dated Feb. 7, 2017, 2 pages.

International Search Report and Written Opinion for PCT/US2016/057225, dated May 18, 2017, 29 pages.

* cited by examiner

CALIBRATION AND STABILIZATION OF AN ACTIVE NOISE CANCELATION SYSTEM

FIELD OF THE INVENTION

This disclosure is related to audio processing and, and, more particularly, to a system and method for calibration and stabilization of an active noise cancellation system in a headphone.

BACKGROUND

Active noise cancellation (ANC) is a conventional method of reducing an amount of undesired noise received by a user listening to audio through headphones. The noise reduction is typically achieved by playing an anti-noise signal through the headphone's speakers. The anti-noise signal is an approximation of the negative of the undesired noise signal that would be in the ear cavity in the absence of ANC. The undesired noise signal is then neutralized when combined with the anti-noise signal.

In a general noise-cancellation process, one or more microphones monitor ambient noise or residual noise in the ear cups of headphones in real-time, then the speaker plays the anti-noise signal generated from the ambient or residual noise. The anti-noise signal may be generated differently depending on factors such as physical shape and size of the headphone, frequency response of the speaker and microphone transducers, latency of the speaker transducer at various frequencies, sensitivity of the microphones, and placement of the speaker and microphone transducers, for example.

In feedforward ANC, the microphone senses ambient noise but does not appreciably sense audio played by the speaker. In other words, the feedforward microphone does not monitor the signal directly from the speaker. In feedback ANC, the microphone is placed in a position to sense the total audio signal present in the ear cavity. So, the microphone senses the sum of both the ambient noise as well as the audio played back by the speaker. A combined feedforward and feedback ANC system uses both feedforward and feedback microphones.

For optimal noise rejection performance, the filter gain values of the feedforward and the feedback ANC paths generally are precisely tuned. Even so, the gain in an ANC path may differ from one part to another. These differences may be due to variations in the sensitivity or efficiency of the speaker and microphone transducers. If the feedforward ANC gain is too high, ambient noise may bleed in to the headphone. Also, if the feedback ANC gain is too high, there may be an increased hiss noise or loud spontaneous oscillations in the audio played by the speaker. On the other hand, if the feedback ANC gain or the feedforward ANC gain is too low, there may be a reduced amount of noise cancellation.

Even after calibration, the feedback ANC gain may increase or decrease from the tuned value. If the gain increases, the feedback ANC path may spontaneously oscillate, with the amplitude of the oscillation limited only by the full scale.

Embodiments of the invention address these and other issues in the prior art.

SUMMARY OF THE DISCLOSURE

Embodiments of the disclosed subject matter determine a characteristic of an audio signal in an active noise cancellation (ANC) system of an earphone and utilize the characteristic to calibrate and reduce instability in the ANC system.

Accordingly, at least some embodiments of a fixture for calibrating an ANC earphone may include an ear model and an acoustic path. The ear model may be configured to support an ANC earphone, and the ear model may include an ear canal extending from an outer end of the ear canal to an inner end of the ear canal. The acoustic path may be external to the ear canal and may extend from, at a first end of the acoustic path, the inner end of the ear canal of the ear model to an opposite, second end of the acoustic path. The acoustic path may be configured to transmit a mechanical sound wave received from the inner end of the ear canal to a region external to the ear model and adjacent the outer end of the ear canal.

In another aspect, at least some embodiments of a method of calibrating an earphone may include: securing an active noise canceling (ANC) earphone to a calibration fixture, the calibration fixture including an ear model configured to support the ANC earphone, the ear model having an ear canal configured to anatomically resemble a human ear canal and a concha configured to anatomically resemble a human ear concha, the ear canal extending from the concha to an inner end of the ear canal; generating, with the ANC earphone, an audio signal based on a reference tone; determining a characteristic of the audio signal; comparing the characteristic of the audio signal to a previously determined reference characteristic; and adjusting a gain value of the ANC earphone based on the comparing.

In yet another aspect, at least some embodiments of a method of reducing feedback instability in an ANC system may include: determining a characteristic of a feedback path signal in a feedback ANC path of an ANC system; determining a characteristic of a second signal in the ANC system, the second signal being outside of the feedback ANC path; comparing the feedback path characteristic to the second signal characteristic; and adjusting a feedback gain value of the feedback ANC path based on the comparing.

In still another aspect, at least some embodiments of a method of reducing feedforward instability in an ANC system may include: determining a characteristic of a feedforward anti-noise signal in a feedforward ANC path of an ANC system; determining a characteristic of a second signal in the ANC system; comparing the feedforward anti-noise characteristic to the second signal characteristic; and adjusting a feedforward gain value of the feedforward ANC path based on the comparing.

DETAILED DESCRIPTION

In general, systems and methods according to embodiments of the invention determine a characteristic of an audio signal in an active noise cancellation (ANC) system of an earphone and utilize the characteristic to calibrate and reduce instability in the ANC system.

During calibration, the earphone may be installed in a calibration fixture, and the calibration fixture may have an acoustic path from an ear canal portion of the calibration fixture to a region near a feedforward microphone of the ANC system. Also, the characteristic determined for calibration of the earphone may be compared to a corresponding characteristic of a reference standard earphone, which was previously set to a desired performance level. The characteristic may be, for example, a power level or an energy level.

To reduce instability, a characteristic of one portion of the ANC system may be compared to a characteristic of another portion of the ANC system. And a gain value within the ANC system may be adjusted based on the comparison. For the stability analysis, the characteristics may be, for example, fast Fourier transform vectors of the one portion and the other portion of the ANC system.

Figure 1:
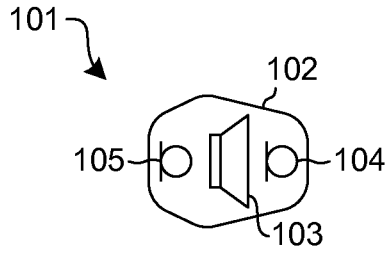
FIG. 1 is a diagrammatic representation showing material portions of an example earphone used to describe aspects of the disclosed systems and methods.

FIG. 1 is a diagrammatic representation showing portions of a conventional earphone used to describe aspects of the disclosed systems and methods. The earphone 101 may be any earphone having an active noise cancellation (ANC) system and that is configured to sit on or in a user's ear. The earphone 101, as illustrated in FIG. 1, may include an earphone enclosure 102, a speaker 103, a feedback microphone 104, and a feedforward microphone 105. The earphone enclosure 102 generally encloses the speaker 103, the feedback microphone 104, and the feedforward microphone 105. The feedback microphone 104 and the feedforward microphone 105 operate generally as described below for FIG. 2.

Although some of the features below are described with respect to an earphone, such as the earphone 101 of FIG. 1, unless otherwise indicated, the features are equally applicable to other types of headphones, including in-ear monitors, and pad- or cup-style headphones that are used in one ear or in both ears.

Figure 2:
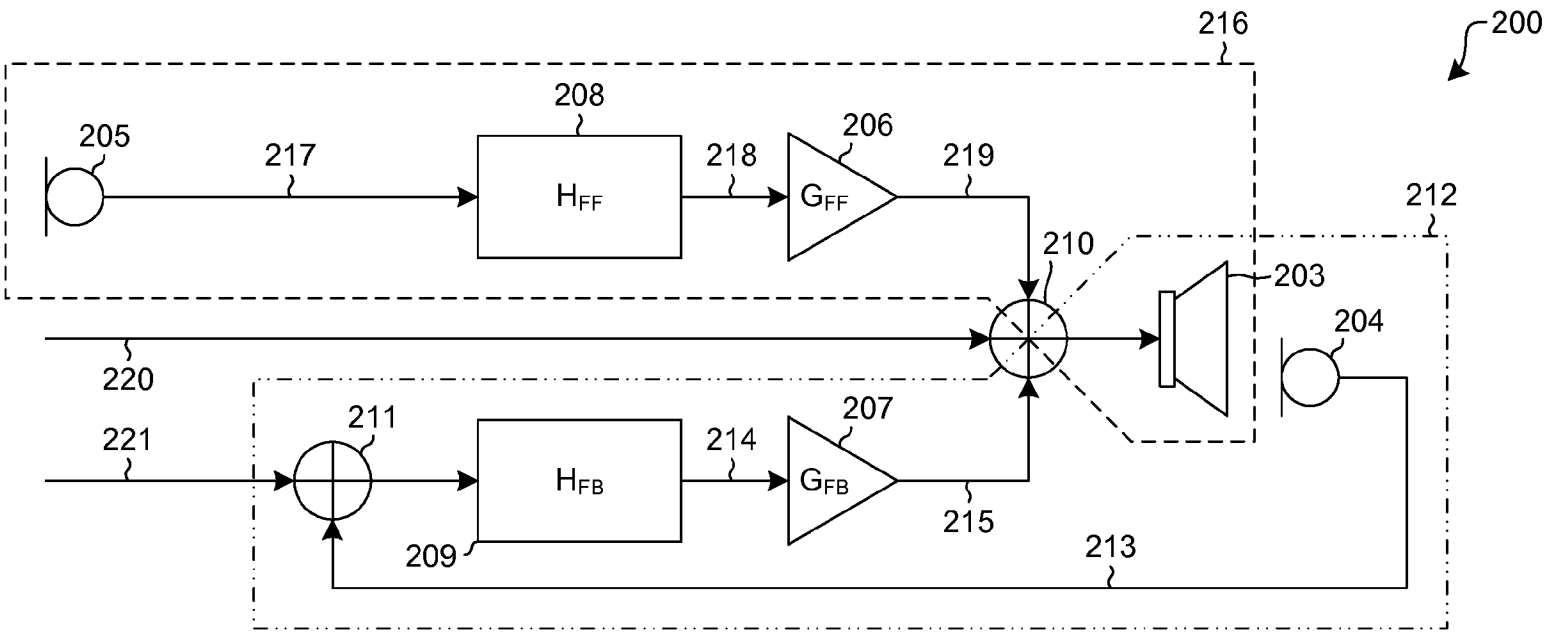
FIG. 2 is a functional block diagram showing material portions of an example ANC system used to describe aspects of the disclosed systems and methods.

FIG. 2 is a functional block diagram showing portions of a conventional ANC system 200 used to describe aspects of the disclosed systems and methods. The ANC system 200 may be an ANC system of an earphone, such as the earphone 101 of FIG. 1. As illustrated in FIG. 2, the ANC system 200 may include a feedforward gain 206, a feedback gain 207, a speaker 203, a feedforward microphone 205, a feedback microphone 204, a feedforward transfer function 208 ($H_{FF}$), a feedback transfer function 209 ($H_{FB}$), a first mixer 210, and a second mixer 211.

In a feedback ANC path 212, the feedback microphone 204 generates a feedback microphone signal 213 based on an audio output of the speaker 203. The feedback transfer function 209 receives the feedback microphone signal 213 and outputs a transformed feedback signal 214 to the feedback gain 207. The feedback gain 207 receives the transformed feedback signal 214 and outputs a feedback anti-noise signal 215 to the speaker 203, which generates the audio output.

In a feedforward ANC path 216, the feedforward microphone 205 generates a feedforward microphone signal 217 based on an ambient noise level. The feedforward transfer function 208 receives the feedforward microphone signal 217 and outputs a transformed feedforward signal 218 to the feedforward gain 206. The feedforward gain 206 receives the transformed feedforward signal 218 and outputs a feedforward anti-noise signal 219 to the speaker 203.

The first mixer 210 is configured to combine the feedback anti-noise signal 215, the feedforward anti-noise signal 219, and a first audio signal 220. The second mixer 211 is configured to combine the feedback microphone signal 213 and a second audio signal 221. The first audio signal 220 may be, for example, a signal characteristic of the desired audio to be played through the speaker 203 as an audio playback signal. Typically, the first audio signal 220 is generated by or derived from an audio source such as a test instrument, a media player, a computer, a radio, a mobile phone, a CD player, or a game console during audio play. The second audio signal 221 may be, for example, the same as the first audio signal 220, derived by filtering the first audio signal 220, or derived by filtering the audio source from which the first audio signal 220 was derived.

Figure 3:
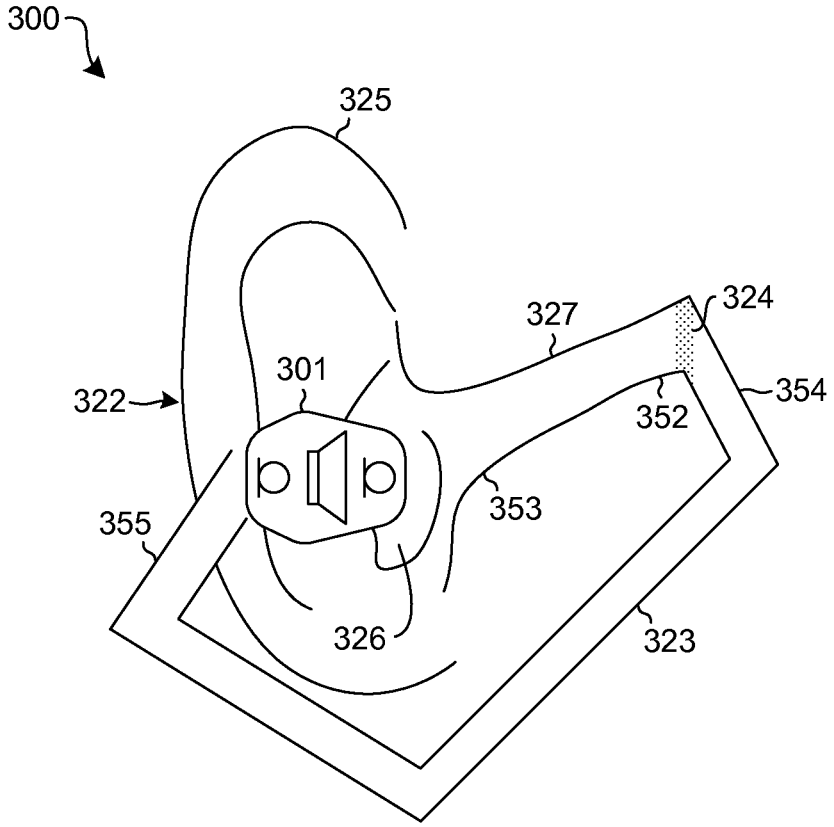
FIG. 3 is a diagrammatic representation showing material portions of a calibration fixture for an earphone, according to embodiments.

In general, the acoustic properties of an earphone depend significantly on the physical characteristics of the ear or the ear model with which it is used. FIG. 3 is a diagrammatic representation showing material portions of an embodiment of a calibration fixture 300 for an earphone 301, or earbud. As illustrated in FIG. 3, a calibration fixture 300 for an earphone 301 may include an ear model 322, a feedforward acoustic path 323, and a damping partition 324.

The ear model 322 is configured to support an earphone, such as the earphone 101 of FIG. 1, during calibration and testing of the earphone 301. The ear model 322 is also configured to resemble all or part of the human ear. Thus, the ear model 322 may include a pinna 325 configured to anatomically resemble a human ear pinna, a concha 326 configured to anatomically resemble a human ear concha, and an ear canal 327 configured to anatomically resemble a human ear canal. The ear canal 327 extends from an outer end 353 of the ear canal 327, at the concha 326, to an inner end of the ear canal 327. Preferably, the ear model 322 is configured to resemble all or part of the human ear with respect to contour and air volume between the earphone 301 and the ear. For example, the ear canal 327 may have a volume of around 1 mL to 2 mL, such as about 1.5 mL, which may approximate the volume of a typical human ear canal.

The feedforward acoustic path 323 has a first end 354 and a second end 355. The feedforward acoustic path 323 is configured to provide an acoustic path from the inner end 352 of the ear canal 327 of the ear model 322 to the feedforward microphone 105 of the earphone 301 under test. The feedforward microphone 105 of the earphone 301 under test may be, for example, in a region external to the ear model 322 and adjacent to the concha 326 of the ear model 322, for example, as shown in FIG. 3.

The damping partition 324 is configured to acoustically negate or reduce the effect of the additional air volume of the feedforward acoustic path 323. This is because coupling the feedforward acoustic path 323 to the ear canal 327 may change the air volume within the ear model 322, resulting in a degraded speaker response. With the damping partition 324, however, the response of the earphone's speaker may be substantially the same as it would be in an ear model 322 that does not include the feedforward acoustic path 323. Accordingly, the damping partition 324 may allow the user to match an impedance of the ear canal 327 to an impedance of a typical human ear canal. As examples, the damping partition 324 may be made from or include resistive cloth or foam.

Figure 4:
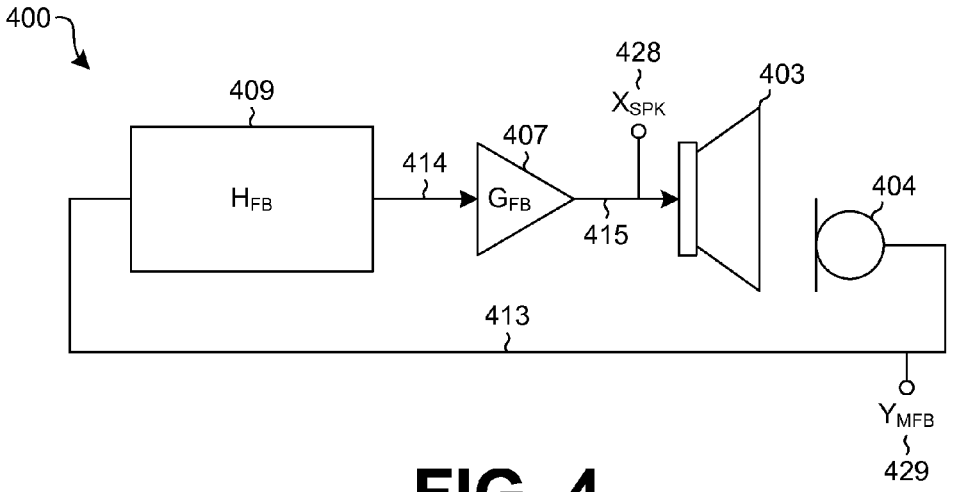
FIG. 4 is a functional block diagram showing material portions of a feedback ANC path for calibration, according to embodiments.

FIG. 4 is a functional block diagram showing material portions of a feedback ANC path 400 for calibration, according to embodiments of the invention. The feedback ANC path 400 for calibration may be a portion of the ANC system 200 of FIG. 2. Also, the feedback ANC path 400 for calibration may be a feedback ANC path 400 of an earphone under calibration, such as the earphone 101 of FIG. 1, installed in a calibration fixture, such as the calibration fixture 300 of FIG. 3. As illustrated in FIG. 4, a feedback ANC path 400 for calibration may include a feedback gain 407, a speaker 403, a feedback microphone 404, and a feedback transfer function 409, $H_{FB}$. The speaker 403 and the feedback microphone 404 may correspond, respectively, to the speaker 103 and the feedback microphone 104 of FIG. 1.

The feedback microphone 404 generates a feedback microphone signal 413 based on an audio output of the speaker 403. The feedback transfer function 409 receives the feedback microphone signal 413 and outputs a transformed feedback signal 414 to the feedback gain 407. The feedback gain 407 receives the transformed feedback signal 414 and outputs a feedback anti-noise signal 415 to the speaker 403, which generates the audio output. Preferably, the feedback gain 407 is a variable gain stage. The feedback gain 407 may be a standalone gain stage, or the feedback gain 407 may be combined with another gain stage in the feedback ANC path 400.

As illustrated in FIG. 4, a gain or level ratio, $T_{FB}$, from an input side 428 of the speaker 403 to a feedback microphone output 429 may be calculated by setting the feedback gain 407, $G_{FB}$, to zero, playing a reference tone at the speaker 403, determining a level, $X_{SPK}$, at the input side 428 of the speaker 403, and determining a level, $Y_{MFB}$, at the feedback microphone output 429.

The reference tone may be a single tone that, for example, has a frequency indicative of the overall gain of the feedforward microphone and the speaker 403. The reference tone also may be a Brown noise. Preferably, the reference tone is a multi-tone, having individual components placed in important bands and weighted differently. For example, the multi-tone may include three tones: a first tone at around 200 Hz and about −20 dBFS, a second tone at around 1000 Hz and about −10 dBFS, and a third tone of around 5000 Hz and about −10 dBFS. These values are just examples, though, and other values may be used, particularly since the values strongly depend on the precise ANC system being calibrated.

From the determined levels $X_{SPK}$ and $Y_{MFB}$, $T_{FB}$ may be given by:

$$T_{FB} = \frac{Y_{MFB}}{X_{SPK}} \text{ (with } G_{FB} \text{ set to 0)} \qquad \text{(Equation 1)}$$

Using Equation 1, the gain $T_{FB}$ of a reference standard may be calculated by determining the level, $X_{SPK}$, at the input side 428 of the speaker 403 of the reference standard, and determining the level, $Y_{MFB}$, at the feedback microphone output 429 of the reference standard. For purposes of this discussion, the gain $T_{FB}$ of the reference standard is referred to as $T_{FB_REF}$.

Preferably, the reference standard is an earphone, such as the earphone 101 of FIG. 1, whose feedback ANC path 400 and feedforward ANC path 500 (see FIG. 5) were previously tuned for optimal performance or otherwise set to a desired performance level. For example, the reference standard may have been manually tuned to a desired performance level. The reference device has a tuned feedback gain 407 that is non-zero and is denoted as $G_{FB_REF}$.

Accordingly, the calibrated feedback gain 407 may be determined by:

$$G_{FB} = G_{FB_{REF}} \cdot \frac{T_{FB_{REF}}}{T_{FB}} + G_{TOL} \qquad \text{(Equation 2)}$$

In Equation 2, $G_{TOL}$ is a tolerance applied to the equation to indicate that, excluding $G_{TOL}$, the right side of Equation 2 need not exactly equal the left side of Equation 2. Even so, $G_{TOL}$ may be set to zero in some embodiments. In other embodiments, $G_{TOL}$ may be preset to another value, such as 0.05 dB or 0.1 dB. Other values, positive or negative, could also be used.

In this way, the feedback gain may be calibrated without a speaker external to the earphone or a microphone external to the earphone. Even so, in some embodiments an external speaker or external microphone, or both, could also be used.

Figure 5:
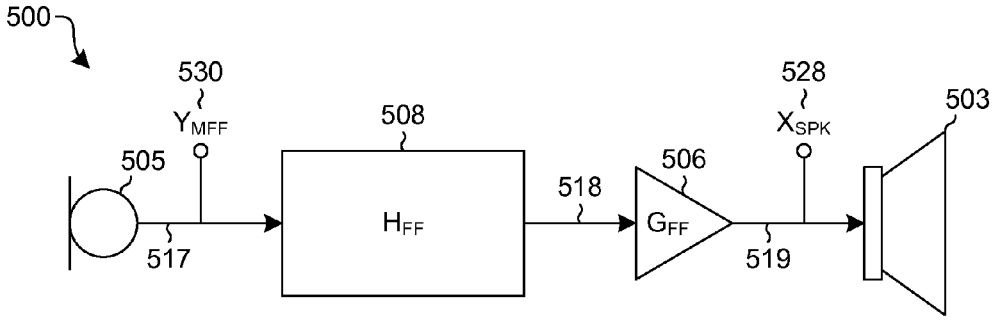
FIG. 5 is a functional block diagram of a feedforward ANC path for calibration with a calibration fixture, according to embodiments.

FIG. 5 is a functional block diagram showing material portions of a feedforward ANC path 500 for calibration with a calibration fixture, according to embodiments of the invention. The feedforward ANC path 500 for calibration may be a portion of the ANC system 200 of FIG. 2. Also, the feedforward ANC path 500 for calibration may be a feedforward ANC path of the earphone under calibration discussed above for FIG. 4, installed in a calibration fixture, such as the calibration fixture 300 of FIG. 3. As illustrated in FIG. 5, a feedforward ANC path 500 for calibration may include a feedforward gain 506, a speaker 503, a feedforward microphone 505, and a feedforward transfer function 508, $H_{FF}$. The speaker 503 and the feedforward microphone 505 may correspond, respectively, to the speaker 103 and the feedforward microphone 105 of FIG. 1.

The feedforward microphone 505 generates a feedforward microphone signal 517 based on an ambient noise level. The feedforward transfer function 508 receives the feedforward microphone signal 517 and outputs a transformed feedforward signal 518 to the feedforward gain 506. The feedforward gain 506 receives the transformed feedforward signal 518 and outputs a feedforward anti-noise signal 519 to the speaker 503. Preferably, the feedforward gain 506 is a variable gain stage. The feedforward gain 506 may be a standalone gain stage, or the feedforward gain 506 may be combined with another gain stage in the feedforward ANC path 500.

With the setup of FIG. 5 and a calibration fixture having a feedforward acoustic path, such as the calibration fixture 300 of FIG. 3, a gain or level ratio, $T_{FF}$, from an input side 528 of the speaker 503 to a feedforward microphone output 530 may be calculated by setting the feedforward gain 506, $G_{FF}$, to zero, playing the reference tone at the speaker 503, determining a level, $X_{SPK}$, at the input side 528 of the speaker 503, and determining a level, $Y_{MFF}$, at the feedforward microphone output 530. The reference tone is generally as described above for FIG. 4.

From the determined levels $X_{SPK}$ and $Y_{MFF}$, $T_{FF}$ may be given by:

$$T_{FF} = \frac{Y_{MFF}}{X_{SPK}} \text{ (with } G_{FF} \text{ set to 0)} \quad \text{(Equation 3)}$$

Using Equation 3, the gain $T_{FF}$ of the reference standard may be calculated by determining the level, $X_{SPK}$, at the input side 528 of the speaker 503 of the reference standard, and determining the level, $Y_{MFF}$, at the feedforward microphone output 530 of the reference standard. For purposes of this discussion, the gain $T_{FF}$ of the reference standard is referred to as $T_{FF_REF}$. The reference device has a tuned feedforward gain 506 that is non-zero and is denoted as $G_{FF_REF}$.

Accordingly, the calibrated feedforward gain 506 may be determined by:

$$G_{FF} = G_{FF_{REF}} \cdot \frac{T_{FF_{REF}}}{T_{FF}} + G_{TOL} \quad \text{(Equation 4)}$$

$G_{TOL}$ is generally as described above for Equation 2. Preferably, $G_{FF}$ is determined after determining $G_{FB}$ for the earphone under calibration, for example, by using the operations discussed above for FIG. 4.

In this way, the feedforward gain may be calibrated without a speaker or a microphone external to the earphone. Even so, in alternative embodiments an external speaker or external microphone, or both, could also be used.

Figure 6:
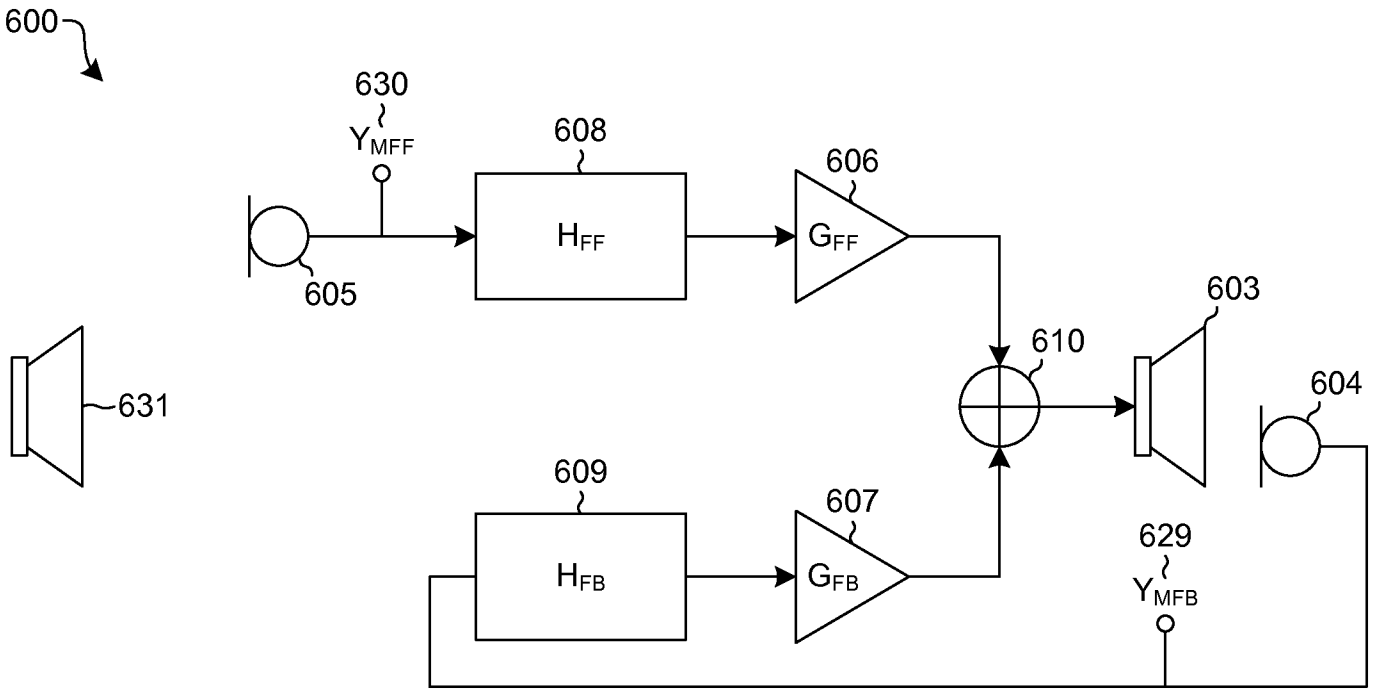
FIG. 6 is a functional block diagram showing material portions of an ANC system for calibration, according to embodiments.

FIG. 6 is a functional block diagram showing material portions of an ANC system 600 for calibration, according to embodiments of the invention. The ANC system 600 for calibration may be an ANC system of the earphone 101 of FIG. 1. In contrast to what is discussed above for FIG. 5, the setup illustrated in FIG. 6 is generally for an earphone installed in a calibration fixture or an ear model that does not have the feedforward acoustic path described above for FIG. 3.

As illustrated in FIG. 6, the ANC system 600 for calibration may include a feedforward gain 606, a feedback gain 607, a speaker 603, a feedforward microphone 605, a feedback microphone 604, a feedforward transfer function 608 ($H_{FF}$), a feedback transfer function 609 ($H_{FB}$), and mixer 610. These components are generally as described above for FIG. 2 and may be part of an earphone, such as the earphone 101 of FIG. 1. The ANC system 600 for calibration may also include a noise source 631, or speaker, that is external to the earphone.

With the setup of FIG. 6, the feedforward gain 606, $G_{FF}$, may be determined by first determining the feedback gain 607, $G_{FB}$, for example, as described above for FIG. 4; playing the reference tone on the external noise source 631; and, while the reference tone is playing, determining the level $Y_{MFB}$ at a feedback microphone output 629 and the level $Y_{MFF}$ at a feedforward microphone output 630. Preferably, the level $Y_{MFB}$ and the level $Y_{MFF}$ are determined substantially simultaneously.

Similar to what is described above for FIGS. 4 and 5, a reference standard, which was previously tuned for optimal performance or otherwise set to a desired performance level, has a tuned feedback gain 607 denoted as $G_{FB_REF}$ and a tuned feedback gain 607 denoted as $G_{FF_REF}$. The reference standard further has a determined level, $Y_{MFB_REF}$, at the feedback microphone output 629 of the reference standard and a determined level, $Y_{MFF_REF}$, at the feedforward microphone output 630 of the reference standard.

Accordingly, the calibrated feedforward gain 606 may be given by Equation 5, where $G_{TOL}$ is generally as described above for Equation 2:

$$G_{FF} = G_{FF_{REF}} \cdot \frac{G_{FB}}{G_{FB_{REF}}} \cdot \frac{Y_{MFB}}{Y_{MFF}} \cdot \frac{Y_{MFF_{REF}}}{Y_{MFB_{REF}}} + G_{TOL} \quad \text{(Equation 5)}$$

The levels discussed with regard to FIGS. 4, 5, and 6 may be, for example a power level or an energy level. In some embodiments, the levels may be estimated or determined by mean-square methods. In embodiments using a Brown noise, a fast Fourier transform (FFT) may be used to estimate the levels in various bands.

Accordingly, referring back to the descriptions of FIGS. 1 to 6, a method of calibrating an earphone may include securing an ANC earphone to a calibration fixture; generating, with the ANC earphone, an audio signal based on a reference tone; determining a characteristic of the audio signal; comparing the characteristic of the audio signal to a previously determined reference characteristic; and adjusting a gain value, of the ANC earphone based on the comparing. The calibration fixture may include an ear model configured to support the ANC earphone. The ear model may have an ear canal configured to anatomically resemble a human ear canal and a concha configured to anatomically resemble a human ear concha. The ear canal may extend from the concha to an inner end of the ear canal.

The operation of determining a characteristic of the audio signal may include setting a feedback gain value to zero; playing the reference tone at a speaker of the ANC earphone while generating the audio signal; and determining a level-ratio between an output of a feedback microphone of the ANC earphone and an input side of the speaker.

The calibration fixture may also include an acoustic path configured to transmit a mechanical sound wave received from the inner end of the ear canal to a region external to the ear model and adjacent the concha of the ear model. In such embodiments, the operation of determining a characteristic of the audio signal may include setting a feedforward gain value to zero; playing the reference tone at a speaker of the ANC earphone while generating the audio signal; and determining a level-ratio from an input side of the speaker to an output of a feedforward microphone of the ANC earphone.

Figure 7:
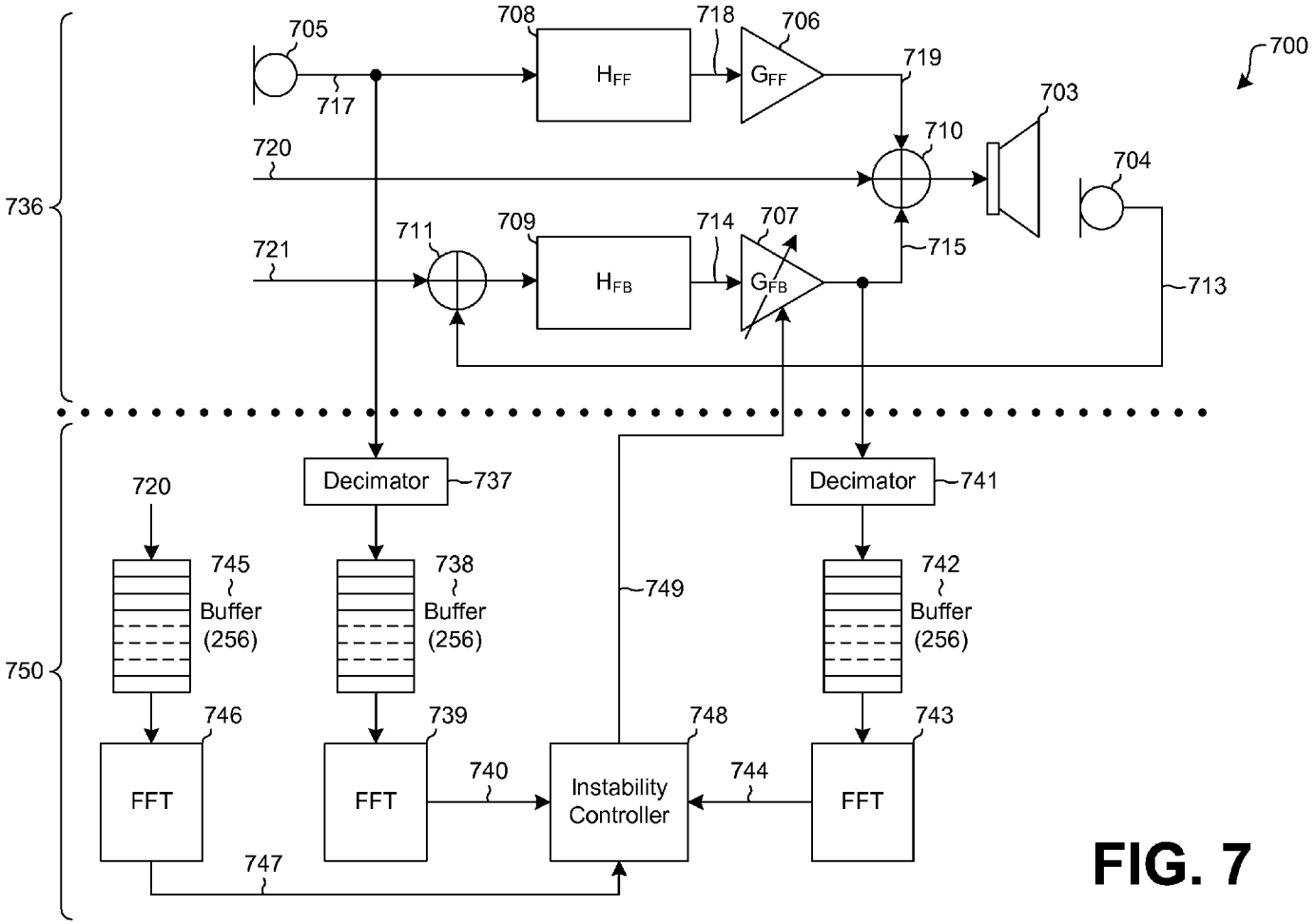
FIG. 7 is a functional block diagram showing material portions of an ANC system having feedback instability control, according to embodiments.

Once calibration is completed, it may be important to detect oscillations in the feedback ANC path and implement instability control measures. FIG. 7 is a functional block diagram showing material portions of an enhanced ANC system 700 having feedback instability control, according to embodiments of the invention. As illustrated in FIG. 7, a feedback microphone 704 generates a feedback microphone signal 703 based on an audio output of a speaker 703. A feedback transfer function 709 receives the feedback microphone signal 703 and outputs a transformed feedback signal 714 to a feedback gain 707. The feedback gain 707 receives the transformed feedback signal 714 and outputs a feedback anti-noise signal 715 to the speaker 703, which generates the audio output.

A feedforward microphone 705 generates a feedforward microphone signal 717 based on an ambient noise level. A feedforward transfer function 708 receives the feedforward microphone signal 717 and outputs a transformed feedforward signal 718 to a feedforward gain 706. The feedforward gain 706 receives the transformed feedforward signal 718 and outputs a feedforward anti-noise signal 719 to the speaker 703.

A first mixer 710 is configured to combine the feedback anti-noise signal 715, the feedforward anti-noise signal 719, and a first audio signal 720. A second mixer 711 is configured to combine the feedback microphone signal 703 and a second audio signal 721. The first audio signal 720 and the second audio signal 721 are generally as describe above for FIG. 2.

Preferably, the feedback microphone 704, the feedforward microphone 705, the speaker 703, the feedback transfer function 709, the feedforward transfer function, the feedback gain 707, the feedforward gain 706, the first mixer 710, and the second mixer 711 are part of an ANC subsystem 736 of an earphone, such as the earphone 101 of FIG. 1.

A first decimator 737 receives the feedforward microphone signal 717 from the feedforward microphone 705 and reduces the sampling rate of the feedforward microphone signal 717. For example, the first decimator 737 may reduce the sampling rate of the feedforward microphone signal 717 to about 48 kHz. The reduced feedforward microphone signal 717 is then temporarily stored in a first buffer 738. A first fast Fourier transform (FFT) transfer function 739 then receives the buffered feedforward microphone signal 717 and determines a discrete Fourier transform of the buffered feedforward microphone signal 717. The output of the first FFT transfer function 739 is referred to in this disclosure as a feedforward noise FFT vector 740.

A second decimator 741 receives the feedback anti-noise signal 715 from the feedback gain 707 and reduces the sampling rate of the feedback anti-noise signal 715. For example, the second decimator 741 may reduce the sampling rate of the feedback anti-noise signal 715 to about 48 kHz. The reduced feedback anti-noise signal 715 is then temporarily stored in a second buffer 742. A second FFT transfer function 743 then receives the buffered feedback anti-noise signal 715 and determines a discrete Fourier transform of the buffered feedback anti-noise signal 715. The output of the second FFT transfer function 743 is referred to in this disclosure as a feedback anti-noise FFT vector 744.

The second decimator 741 preferably receives the feedback anti-noise signal 715. Alternatively, the second decimator 741 may instead receive and reduce the sampling rate of the feedback microphone signal 703 or the transformed feedback signal 714, which is then temporarily stored in the second buffer 742 and acted on by the second FFT transfer function 743 as described here.

The first audio signal 720 is temporarily stored in a third buffer 745. A third FFT transfer function 746 then receives the buffered first audio signal 720 and determines a discrete Fourier transform of the buffered first audio signal 720. The output of the third FFT transfer function 746 is referred to in this disclosure as a forward audio FFT vector 747. Although not shown in FIG. 7, the first audio signal 720 may also be decimated before being acted upon by the third FFT transfer function 746.

Preferably, the first buffer 738, the second buffer 742, and the third buffer 745 are each configured to store 256 samples. Thus, where the first decimator 737 and the second decimator 741 each provide samples at about 48 kHz, the first buffer 738 and the second buffer 742 may include a delay of about 5.3 milliseconds to store the 256 samples. Preferably, a window, such as a triangular window, a Hanning window, or a Hamming window, is applied to the buffered feedforward microphone signal 717, the buffered feedback anti-noise signal 715, and the buffered first audio signal 720 before its respective discrete Fourier transform is determined. Additionally, where the first buffer 738, the second buffer 742, and the third buffer 745 are each configured to store 256 samples, the first FFT transfer function 739, the second FFT transfer function 743, and the third FFT transfer function 746 are preferably each configured to perform a 256-point FFT.

An instability controller 748 may collect the feedforward noise FFT vector 740, the feedback anti-noise FFT vector 744, and the forward audio FFT vector 747, and also make an instability determination based on one or more of those collected vectors. For example, the instability controller 748 may perform a bin-wise comparison of the feedforward noise FFT vector 740 to the feedback anti-noise FFT vector 744. As another example, the instability controller 748 may determine that an instability exists if, during a bin-wise comparison of the feedforward noise FFT vector 740 to the feedback anti-noise FFT vector 744, a bin of the feedforward noise FFT vector 740 exceeds the feedback anti-noise FFT vector 744 in a corresponding bin plus a first threshold vector. In other words, if the instability controller 748 is comparing bin number 24, then an instability is determined to be present if the value in bin number 24 of the feedforward noise FFT vector 740 exceeds the sum of the first threshold vector plus the value in bin number 24 of the feedback anti-noise FFT vector 744. In some embodiments, though, the comparison may be made without adding the first threshold vector to the feedback anti-noise FFT vector 744 or by setting the first threshold vector to zero.

Alternatively or additionally, the instability controller 748 may perform a bin-wise comparison of the forward audio FFT vector 747 to the feedback anti-noise FFT vector 744. For example, the instability controller 748 may determine that an instability exists if, during a bin-wise comparison of the forward audio FFT vector 747 to the feedback anti-noise FFT vector 744, a bin of the forward audio FFT vector 747 exceeds the feedback anti-noise FFT vector 744 in a corresponding bin plus a second threshold vector. In some embodiments, though, the comparison may be made without adding the second threshold vector to the feedback anti-noise FFT vector 744 or by setting the second threshold vector to zero. Preferably, the second threshold vector is not identical to the first threshold vector.

If the instability controller 748 determines that an instability exists, then the instability controller 748 may output instructions 749 to the feedback gain 707 to reduce a feedback gain 707 value. In this way, instability control may be provided to the feedback ANC path of the ANC system.

Preferably, the second decimator 741, the first buffer 738, the second buffer 742, the third buffer 745, the first FFT transfer function 739, the second FFT transfer function 743, the third FFT transfer function 746, and the instability controller 748 are part of a digital signal processor 750. The digital signal processor 750 may reside, for example, in an earphone, such as the earphone 101 of FIG. 1.

Figure 8:
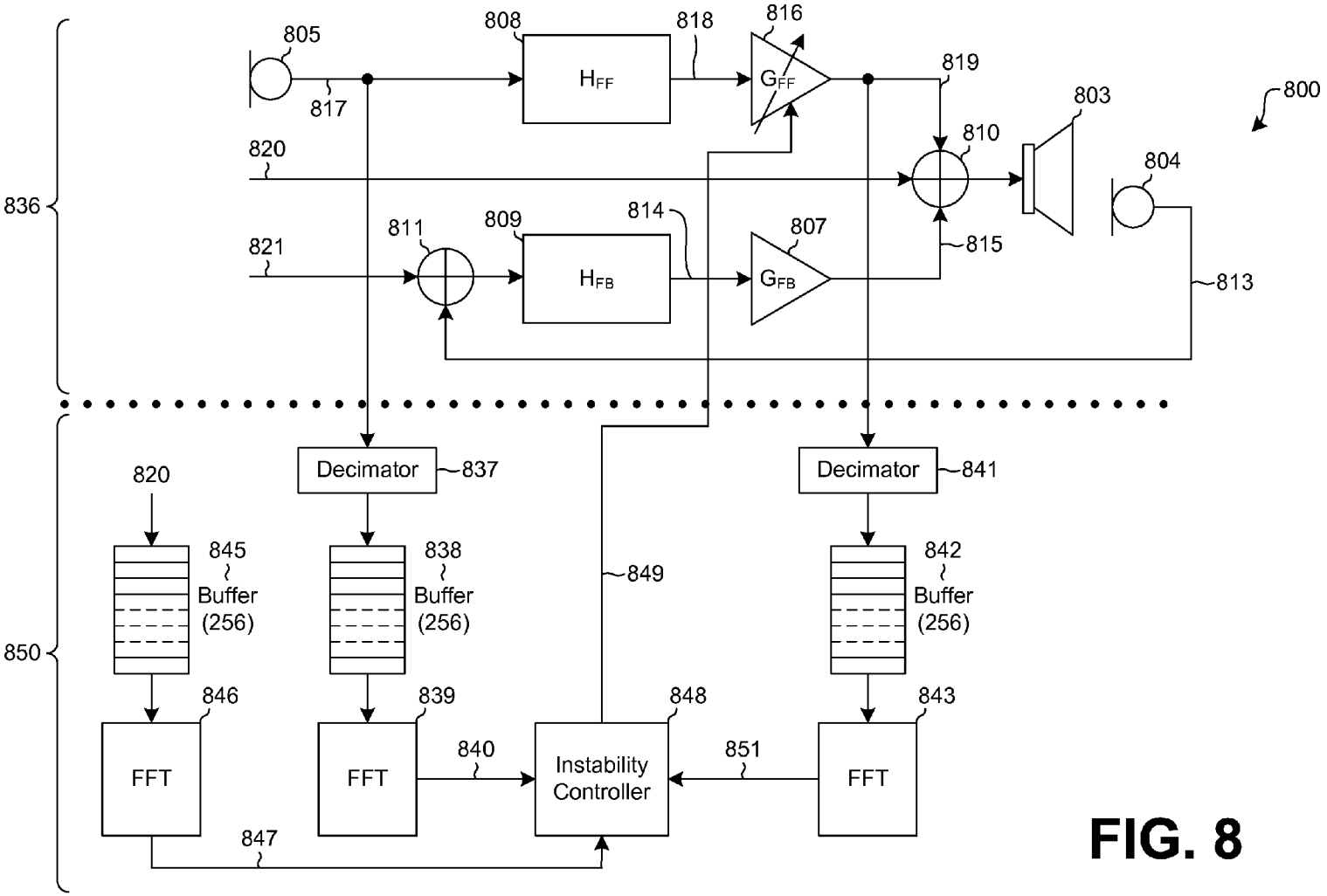
FIG. 8 is a functional block diagram showing material portions of an ANC system having feedforward instability control, according to embodiments.

FIG. 8 is a functional block diagram showing material portions of an enhanced ANC system 800 having feedforward instability control, according to embodiments of the invention. As illustrated in FIG. 8, a feedback microphone 804 generates a feedback microphone signal 813 based on an audio output of a speaker 803. A feedback transfer function 809 receives the feedback microphone signal 813 and outputs a transformed feedback signal 814 to a feedback gain 807. The feedback gain 807 receives the transformed feedback signal 814 and outputs a feedback anti-noise signal 815 to the speaker 803, which generates the audio output.

A feedforward microphone 805 generates a feedforward microphone signal 817 based on an ambient noise level. A feedforward transfer function 808 receives the feedforward microphone signal 817 and outputs a transformed feedforward signal 818 to a feedforward gain 806. The feedforward gain 806 receives the transformed feedforward signal 818 and outputs a feedforward anti-noise signal 819 to the speaker 803.

A first mixer 810 is configured to combine the feedback anti-noise signal 815, the feedforward anti-noise signal 819, and a first audio signal 820. A second mixer 811 is configured to combine the feedback microphone signal 813 and a second audio signal 821. The first audio signal 820 and the second audio signal 821 are generally as describe above for FIG. 2.

Preferably, the feedback microphone 804, the feedforward microphone 805, the speaker 803, the feedback transfer function 809, the feedforward transfer function, the feedback gain 807, the feedforward gain 806, the first mixer 810, and the second mixer 811 are part of an ANC subsystem 836 of an earphone, such as the earphone 101 of FIG. 1.

A first decimator 837 receives the feedforward microphone signal 817 from the feedforward microphone 805 and reduces the sampling rate of the feedforward microphone signal 817. The reduced feedforward microphone signal 817 is then temporarily stored in a first buffer 838. A first fast Fourier transform (FFT) transfer 839 function then receives the buffered feedforward microphone signal 817 and determines a discrete Fourier transform of the buffered feedforward microphone signal 817. The output of the first FFT transfer function 839 is referred to in this disclosure as the feedforward noise FFT vector 840.

A second decimator 841 receives the feedforward anti-noise signal 819 from the feedforward gain 806 and reduces the sampling rate of the feedforward anti-noise signal 819. The reduced feedforward anti-noise signal 819 is then temporarily stored in a second buffer 842. A second FFT transfer function 843 then receives the buffered feedforward anti-noise signal 819 and determines a discrete Fourier transform of the buffered feedforward anti-noise signal 819. The output of the second FFT transfer function 843 is referred to in this disclosure as the feedforward anti-noise FFT vector 851.

The second decimator 841 preferably receives the feedforward anti-noise signal 819. Alternatively, the second decimator 841 may instead receive and reduce the sampling rate of the feedforward microphone signal 817 or the transformed feedforward signal 818, which is then temporarily stored in the second buffer 842 and acted on by the second FFT transfer function 843.

The first audio signal 820 is temporarily stored in a third buffer 845. A third FFT transfer function 846 then receives the buffered first audio signal 820 and determines a discrete Fourier transform of the buffered first audio signal 820. The output of the third FFT transfer function 846 is referred to in this disclosure as the forward audio FFT vector 847.

Preferably, the first buffer 838, the second buffer 842, and the third buffer 845 are each configured to store 256 samples. Preferably, a window, such as a triangular window, a Hanning window, or a Hamming window, is applied to the buffered feedforward microphone signal 817, the buffered feedforward anti-noise signal 819, and the buffered first audio signal 820 before its respective discrete Fourier transform is determined.

An instability controller 848 may collect the feedforward noise FFT vector 840, the feedforward anti-noise FFT vector 851, and the forward audio FFT vector 847, and also make an instability determination. For example, the instability controller 848 may perform a bin-wise comparison of the feedforward noise FFT vector 840 to the feedforward anti-noise FFT vector 851. As another example, the instability controller 848 may determine that an instability exists if, during a bin-wise comparison of the feedforward noise FFT vector 840 to the feedforward anti-noise FFT vector 851, a bin of the feedforward noise FFT vector 840 exceeds the feedforward anti-noise FFT vector 851 in a corresponding bin plus a first feedforward threshold vector. In other words, if the instability controller 848 is comparing bin number 77, then an instability is determined to exist if the value in bin number 77 of the feedforward noise FFT vector 840 exceeds the sum of the first feedforward threshold vector plus the value in bin number 77 of the feedforward anti-noise FFT vector 851.

Alternatively or additionally, the instability controller 848 may perform a bin-wise comparison of the forward audio FFT vector 847 to the feedforward anti-noise FFT vector 851. For example, the instability controller 848 may determine that an instability exists if, during a bin-wise comparison of the forward audio FFT vector 847 to the feedforward anti-noise FFT vector 851, a bin of the forward audio FFT vector 847 exceeds the feedforward anti-noise FFT vector 851 in a corresponding bin plus a second feedforward threshold vector. Preferably, the second feedforward threshold vector is not identical to the first feedforward threshold vector.

If the instability controller 848 determines that an instability exists, then the instability controller 848 may output instructions 849 to the feedforward gain 806 to reduce a feedforward gain 806 value. In this way, instability control may be provided to the feedforward ANC path of the ANC system.

Preferably, the second decimator 841, the first buffer 838, the second buffer 842, the third buffer 845, the first FFT transfer function 839, the second FFT transfer function 843, the third FFT transfer function 846, and the instability controller 848 are part of a digital signal processor 850. The digital signal processor 850 may reside, for example, in an earphone, such as the earphone 101 of FIG. 1.

Although shown separately in FIGS. 7 and 8, in some embodiments an ANC system may have both feedback instability control and feedforward instability control. Additionally, although the discussion of FIGS. 7 and 8 focuses on FFT transfer functions, other signal processing methods may also be used if the signal processing method can resolve the signal into different components or characteristics. As an example, a signal may be processed in the time domain by using signal correlation.

Embodiments of the invention may operate on a particularly created hardware, on firmware, digital signal processors, or on a specially programmed general purpose computer including a processor operating according to programmed instructions. The terms "controller" or "processor" as used herein are intended to include microprocessors, microcomputers, ASICs, and dedicated hardware controllers. One or more aspects of the invention may be embodied in computer-usable data and computer-executable instructions, such as in one or more program modules, executed by one or more computers (including monitoring modules), or other devices. Generally, program modules include routines, programs, objects, components, data structures, etc. that perform particular tasks or implement particular abstract data types when executed by a processor in a computer or other device. The computer executable instructions may be stored on a non-transitory computer readable medium such as a hard disk, optical disk, removable storage media, solid state memory, RAM, etc. As will be appreciated by one of skill in the art, the functionality of the program modules may be combined or distributed as desired in various embodiments. In addition, the functionality may be embodied in whole or in part in firmware or hardware equivalents such as integrated circuits, field programmable gate arrays (FPGA), and the like. Particular data structures may be used to more effectively implement one or more aspects of the invention, and such data structures are contemplated within the scope of computer executable instructions and computer-usable data described herein.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Although specific embodiments of the invention have been illustrated and described for purposes of illustration, it will be understood that various modifications may be made without departing from the spirit and scope of the invention. Accordingly, the invention should not be limited except as by the appended claims.

The invention claimed is:

1. A method of calibrating an earphone, the method comprising:

securing an active noise canceling (ANC) earphone to a calibration fixture, the calibration fixture including an ear model configured to support the ANC earphone, the ear model having an ear canal configured to anatomically resemble a human ear canal and a concha configured to anatomically resemble a human ear concha, the ear canal extending from the concha to an inner end of the ear canal;

generating, with the ANC earphone, a first audio signal based on a first reference tone;

determining a characteristic of the first audio signal;

comparing the characteristic of the first audio signal to a previously determined reference characteristic; and adjusting a gain value of the ANC earphone based on the comparing, in which the determining the characteristic of the first audio signal includes:

setting a feedback gain value to zero;

playing the first reference tone at a speaker of the ANC earphone while generating the first audio signal; and determining a first level-ratio between an output of a feedback microphone of the ANC earphone and an input side of the speaker.

2. The method of claim 1, in which the comparing the characteristic of the first audio signal to a previously determined reference characteristic includes comparing the determined first level-ratio to a previously determined reference first level-ratio, and in which the adjusting the gain value of the ANC earphone includes adjusting a feedback gain value of the ANC earphone based on the first level-ratio, the reference first level-ratio, and a previously determined reference feedback-gain value.

3. The method of claim 2, further comprising, after the adjusting the feedback gain value of the ANC earphone:

playing a second reference tone at a noise source external to the ANC earphone while generating, with the ANC earphone, a second audio signal based on the second reference tone;

determining a second level-ratio from an output of a feedforward microphone of the ANC earphone to the output of the feedback microphone of the ANC earphone;

comparing the second level-ratio to a previously determined reference second level-ratio; and adjusting a feedforward gain value of the ANC earphone based on the second level-ratio, a previously determined reference feedforward-gain value, and the reference second level-ratio.

4. A method of calibrating an earphone, the method comprising:

securing an active noise canceling (ANC) earphone to a calibration fixture, the calibration fixture including an ear model configured to support the ANC earphone, the ear model having an ear canal configured to anatomically resemble a human ear canal and a concha configured to anatomically resemble a human ear concha, the ear canal extending from the concha to an inner end of the ear canal;

generating, with the ANC earphone, an audio signal based on a reference tone;

determining a characteristic of the audio signal;

comparing the characteristic of the audio signal to a previously determined reference characteristic; and adjusting a gain value of the ANC earphone based on the comparing, in which the calibration fixture further includes an acoustic path configured to transmit a mechanical sound wave received from the inner end of the ear canal to a region external to the ear model and adjacent the concha of the ear model, and in which the determining the characteristic of the audio signal includes:

setting a feedforward gain value to zero;

playing the reference tone at a speaker of the ANC earphone while generating the audio signal; and determining a level-ratio from an input side of the speaker to an output of a feedforward microphone of the ANC earphone.

5. The method of claim 4, in which the adjusting the gain value of the ANC earphone includes adjusting a feedforward gain value of the ANC earphone.

* * * * *